US006065229A

United States Patent [19]

Wahrheit

[11] Patent Number: 6,065,229

[45] Date of Patent: May 23, 2000

[54] MULTIPLE-PART FOOT-SUPPORT SOLE

[76] Inventor: Gerhard Maximilian Wahrheit, Adolf-Ludwig-Ring 124, Pirmasens/Pfalz, Germany, 6780

[21] Appl. No.: 08/272,147

[22] Filed: Jul. 8, 1994

Related U.S. Application Data

[63] Continuation-in-part of application No. 08/067,239, May 26, 1993.

[30] Foreign Application Priority Data

May 26, 1992 [DE] Germany ..... 92 07 101 U
Sep. 24, 1992 [DE] Germany ..... 92 12 852 U

[51] Int. Cl.[7] ..... A43B 13/00; A43B 13/12

[52] U.S. Cl. ..... 36/25 R; 36/30 R; 36/31; 36/37

[58] Field of Search ..... 36/25 R, 30 R, 36/30 A, 31, 28, 34 R, 37, 81, 169, 172

[56] References Cited

U.S. PATENT DOCUMENTS

| | | | |
|---|---|---|---|
| 588,977 | 8/1897 | Gilbert | 36/37 |
| 1,694,353 | 12/1928 | Messler | 36/37 |
| 2,620,574 | 12/1952 | Pepperman, Jr. | 36/172 |
| 2,838,776 | 6/1958 | Tax | 36/169 |
| 4,043,058 | 8/1977 | Hollister et al. | 36/28 |
| 4,128,950 | 12/1978 | Bowerman et al. | 36/28 |
| 4,590,123 | 5/1986 | Hashimoto | 36/30 R |
| 4,663,865 | 5/1987 | Telecemian | 36/30 R |
| 4,794,707 | 1/1989 | Franklin et al. | 36/30 R |

*Primary Examiner*—M. D. Patterson
*Attorney, Agent, or Firm*—Cohen, Pontani, Lieberman & Pavane

[57] ABSTRACT

A multiple-part foot-support sole having a cork support with a thickness that is minimal under a heel and under a ball of the wearer's foot. A wedge is arranged under the foot support so that a front edge of the wedge lies approximately under the ball of the wearer's foot and encloses an angle between 75 and 80° relative to the longitudinal center line of the sole. The wedge has a substantially flat upper and lower side and is made of a lightweight and flexible material. An outsole is provided under the wedge in the cork foot support so as to be sharply raised in a toe region of the sole while the cork foot support is only slightly curved in the toe region.

17 Claims, 2 Drawing Sheets

8
2
7
12
DZ
13
A
2.3
5
3
11
L
L/4
L/3

6
10
9
B
1
2
3
7
2.1
2.2
12
DZ
13
2.3
5
4
L
L/4
L/3

MULTIPLE-PART FOOT-SUPPORT SOLE

RELATED APPLICATIONS

This application is a continuation-in-part of application Ser. No. 08/067,239 filed May 26, 1993.

BACKGROUND OF THE INVENTION

Field of the Invention

Shoes should protect the human foot from injury, shield it from cold and heat, reduce shocks to the skeleton when walking and particularly when running, and should provide support and a reliable grip when walking and standing. For this reason, very different kinds of shoes are manufactured, these shoes being optimized for their specific use. Persons having to stand for long periods of time prefer shoes with a foot support which reduces the load on the feet. Athletes prefer shoes with a thick, resilient sole which absorbs impact and temporarily stores running energy in a resilient manner. Mountain climbers prefer shoes with a stable sole which will also not be damaged by sharp rocks. Golfers prefer shows with spikes which ensure a good grip. Women generally prefer shoes with a higher heel. Additionally, a requirement for all shoes is that they should be attractive and have a long useful life.

U.S. Pat. Nos. 4,128,950, 4,449,306 and 4,759,136 disclose running shoes for athletes. All of these shoes have a continuous thick, triple-part, resilient elastic sole construction whose heel is raised by a heel wedge. The front edge of the heel wedge ends roughly halfway along the length of the shoe.

U.S. Pat. No. 2,435,976 shows a shoe whose multiple-part sole includes a part comprising a substantially inflexible material. The sole is uniformly curved from the toe to the heel. This shoe allows patients with all artificial leg to walk easily and naturally. Such a shoe cannot be worn by normal, healthy individuals.

U.S. Pat. No. 4,463,505 shows a boot with a multiple-part sole in which are incorporated special orthopedic supports for patients with foot ailments.

U.S. Pat. No. 2,603,891 shows a washable slipper with a multiple-part sole, the insole being made of multiple layers of a mixture of cork and rubber which are glued together. The upper side of the insole facing the foot is completely flat and the foot is not supported.

U.S. Pat. No. 617,701 discloses the use of thin insoles of cork in shoes. Tile foot is not supported by this insole.

U.S. Pat. No. 4,852,273 discloses a two-part sole in which both parts are made of foamed plastic and are glued together. The insole has a foot support and a plurality of small and large channels, particularly in the metatarsal region of the foot. The outsole is thick, resiliently elastic and is provided with a special profiling. The outer surface is beveled under the toes and under tile heel. Tile sole of the wearer's foot is actively ventilated during walking by means of the combined action of the outsole and insole so as to prevent the foot from perspiring.

SUMMARY OF THE INVENTION

The present invention has the object of providing a multiple-part foot-support sole for shoes which is light, provides optimum support for the foot while standing, and at tile same time enables a very dynamic and elastic walking action.

A further object of the invention is to dampen shocks to the heel during walking without having to manufacture one of the sole parts from a thick, resiliently elastic material.

The invention has the additional object of adapting the shape of tile different individual parts of the sole to the anatomy of the foot in an optimal manner.

A further object of the invention is to protect the cork foot support of the sole from damage.

Finally, the invention has the object of enabling a simple and inexpensive production of the multiple part sole.

Pursuant to these objects, and others which will become apparent hereafter, one aspect of the present invention resides in a multiple-part foot-support sole having a cork foot support whose thickness is minimal under the heel and under the ball of the wearer's foot. The thickness is a minimal amount required for providing tile required wear and longevity of a shoe foot support. A wedge is provided under the foot support so that a front edge of the wedge lies approximately under the ball of the wearer's foot. The wedge forms an angle of 75–80° relative to a longitudinal center line of the sole. Also, the wedge is made of a lightweight and flexible material so as to dampen impacts on the foot. The wedge further has flat upper and lower sides. An outsole is provided tinder the wedge and the cork foot support so as to have a sharply raised toe region while the cork foot support has only a slightly curved shape in the toe region.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
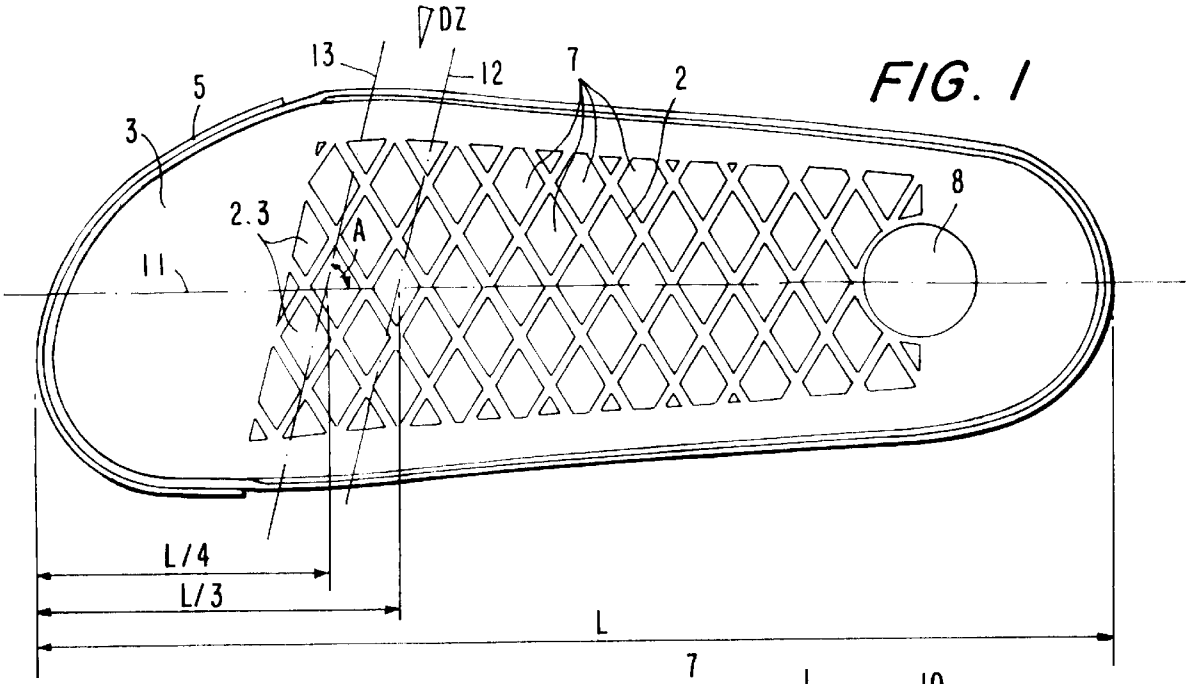
FIG. 1 shows a top view of the upper side of a multiple-part foot-support sole pursuant to the present invention without a cork foot support.

FIG. 1 shows a top view of two parts of a multiple-part foot-support sole for shoes. The drawing shows an outsole 3 with a wedge 2 that is attached on the outsole 3 and provided with a plurality of cut out portions 7 to reduce weight. A circular cut out portion 8 in which a heel cushion 9 (FIG. 2) can be inserted is shown in the region of the heel. Finally, the center line 11 of the sole is shown.

The position and angle of the front edge 13 of the wedge 2 are essential to the sole according to the invention). This edge 13 extends into this region of the ball of the foot (FIG. 5) and encloses an angle A of 75 to 80 degrees, preferably 77 degrees, with tile longitudinal axis 11 of the shoe. The wedge 2 itself has, in addition, a transitional area 2.3 leading to the outsole 3.

Figure 2:
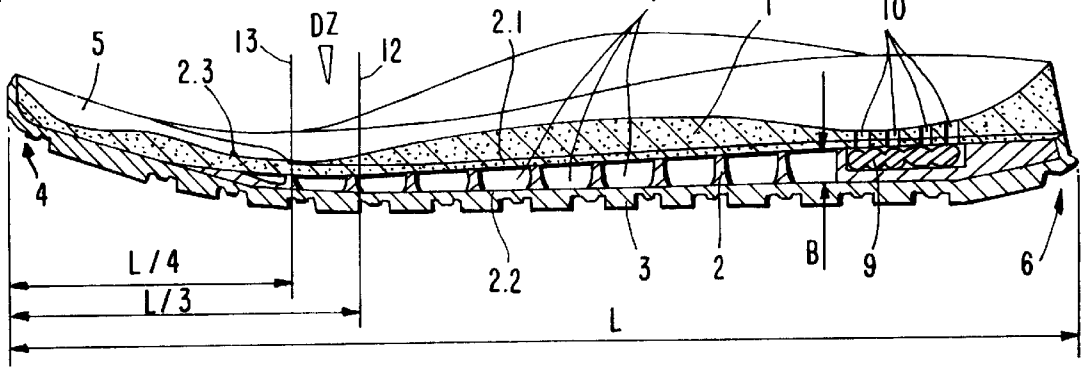
FIG. 2 shows a longitudinal section through a multiple-part foot-support sole with a cork foot support.

Further details of the invention are shown in FIG. 2. A cork foot support 1 is attached to tile wedge 2 and the outsole 3 in this drawing. A shell ridge 5 in the toe region protects the side edge of the cork foot support 1 from damage.

The cork foot support 1 has only a slight, so-to-speak, natural curvature in the toe region 4. On the other hand, the outsole 3 is sharply raised, sloped or curved upwardly in the toe region 4 so as to have a shape similar to a gondola. In other words the toe region of the outsole has a gondola-like shape. The gondola-like shape starts at the location indicated by line 12. The wedge 2 and its front edge 2.3 are responsible for this difference in shape between the cork foot support 1 and tile outsole 3.

The outsole 3 is also raised in the heel region 6 to facilitate tile rolling of tile foot when running the upper and lower sides 2.1, 2.2, respectively, of tile wedge 2 are completely flat along almost the entire length of the wedge. They enclose a small angle B of 4 to 12 degrees so that the heel is somewhat raised.

A resilient heel cushion 9 is inserted in the cut out portion 8 in the region of the heel. The cork foot support 1 which has a minimal thickness in this region also has a series of perforations 10 so that the cushion effect of the heel cushion 9 remains completely effective.

As shown in FIGS. 1 and 2, the intersection between the longitudinal axis 11 of tile shoe and the line 13 corresponding to the ball of the foot is at a distance from the tip of the shoe corresponding to one-fourth of the entire length L of the sole. Tile line 12 corresponding to the start of the gondola shape in the toe region 4 has a distance from the tip of the shoe corresponding to one-third of the length L of the sole. A so-called dynamic zone DZ which is responsible for the particularly dynamic and resilient walking enabled by the inventive sole is located between the two lines 12, 13. However, at the same time, tile sole also offers optimal support of the foot when standing, which is ensured by the combined action of the wedge 2 and tile cork foot support 1. Accordingly, shoes can be produced with the sole according to the invention which allow tile wearer to stand for long periods of time without fatigue and to walk dynamically for long periods of time.

Figure 3:
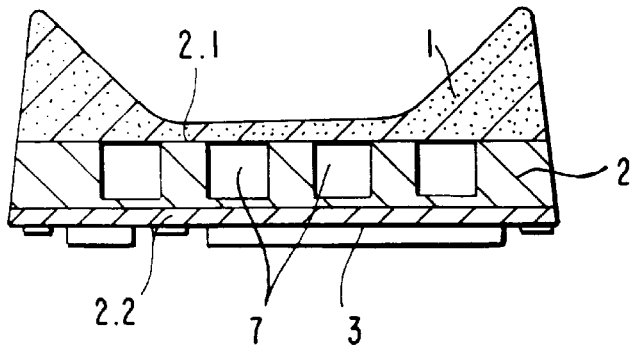
FIG. 3 shows a cross section through the sole shown in FIG. 2 in the region of tile heel.

FIG. 3 shows a cross section through the sole of FIG. 2 in the region of the heel. It can be seen that the cork foot support 1 supports the heel laterally. Tile wedge 2 has a greater thickness in this instance and its tipper and lower sides 2.1, 2.2, respectively, are completely flat.

Figure 4:
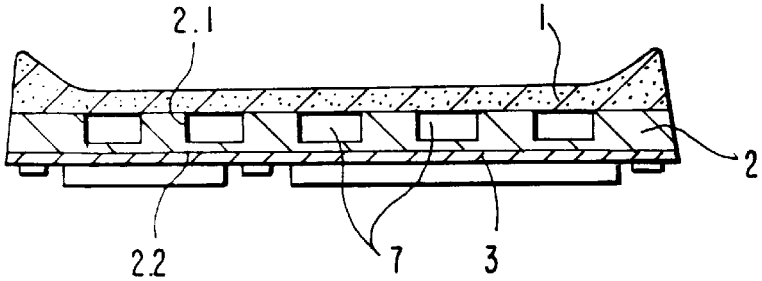
FIG. 4 shows a cross section through the sole shown in FIG. 2 in the region of the front part of the foot.

FIG. 4 shows another cross section through the sole shown in FIG. 2 in the region of the front of the foot. It can be seen that the wedge 2 has a lesser thickness in this region than in the heel region.

FIGS. 3 and 4 show that the wedge 2 and the outsole 3, in contrast to tile embodiment in FIGS. 1 and 2, can also be produced separately and then glued together.

Figure 5:
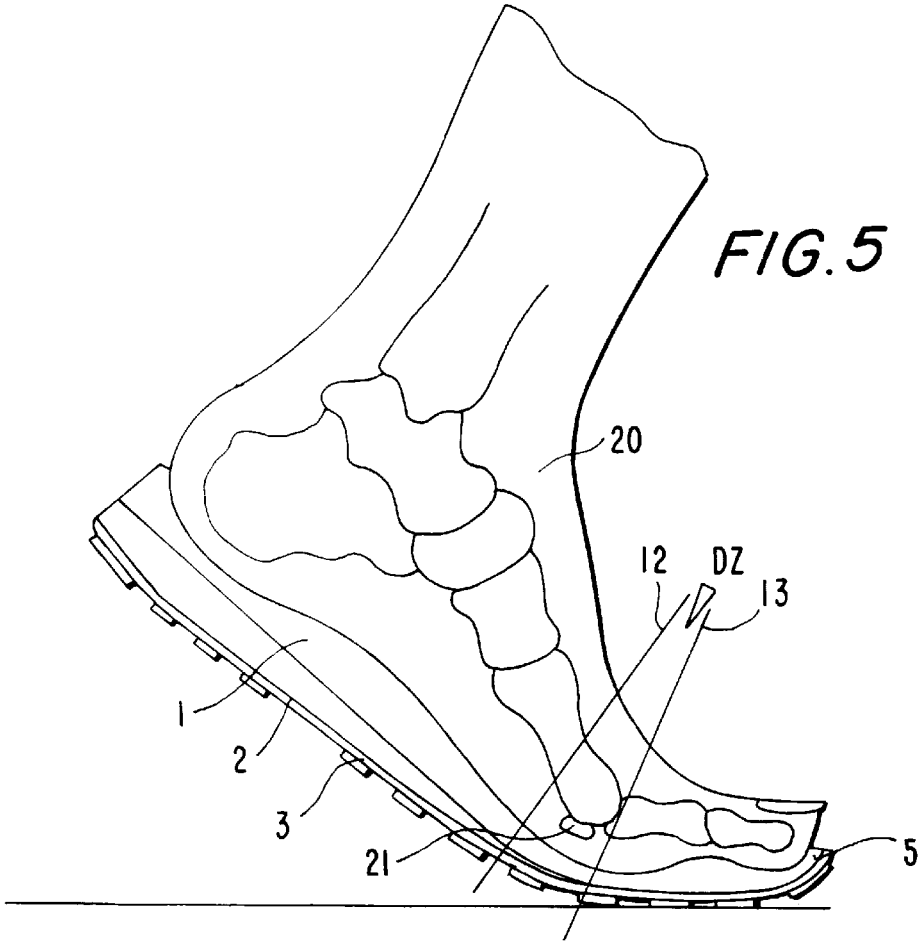
FIG. 5 shows a schematic side view of the foot and foot-support sole during walking.

Finally, FIG. 5 shows a side view of the sole 1, 2 and 3 and a foot 20 when walking. It can be seen that the sole deforms in the region of tile dynamic zone DZ, while tile remaining regions of the sole are hardly deformed. It can further be seen that the line 13 indicating the front edge of the wedge 2 is positioned in the region of the ball of the foot 21.

The invention is not limited by the embodiments described above which are presented as examples only built can be modified in various ways within the scope of protection defined by the appended patent claims.

What is claimed is:

1. A multiple-part foot-support sole, comprising: a cork foot support having a thickness that is minimal under a heel and under a ball of a wearer's foot; a wedge arranged under the foot support so that a front edge of the wedge lies approximately under the ball of the wearer's foot and forms an angle between 75 and 80° relative to a longitudinal center line of the sole, said wedge being of a lightweight and flexible material, said wedge having an upper side and a lower side that are substantially flat; and an outsole provided under the wedge and the cork foot support, a front part of the lower side of the wedge and the outsole being sharply raised in a toe region, the cork foot support being only slightly curved in the toe region.

2. A foot-support sole according to claim 1, and further comprising a heel cushion positioned between the cork foot support and tile wedge under the heel where the thickness of the cork foot support is minimal.

3. A foot-support sole according to claim 2, wherein the wedge has a cut-out in a region of the heel, the heel cushion being positioned in the cut out of the wedge.

4. A foot-support sole according to claim 2, wherein the cork foot support is perforated in the region of the heel cushion.

5. A foot-support sole according to claim 1, wherein the sole has a length and a tip in the toe region, the front edge of the wedge and the center line being arranged so as to intersect at a distance of approximately one fourth of the length of the sole as measured from the tip of the sole.

6. A foot-support sole according to claim 1, wherein the sole has a length and a tip in the toe region, the outsole being provided so that its rise beings at a distance of approximately one third of the length of the sole as measured from the tip of the sole.

7. A foot-support sole according to claim 1, wherein the outsole has a shell ridge arranged to at least partially cover a lateral surface of the cork foot support.

8. A foot-support sole according to claim 1, wherein the outsole has a shell ridge in the toe region, which shell ridge is provided so as to end roughly at locations where the front edge of the wedge intersects the edges of the sole.

9. A foot-support sole according to claim 1, wherein the wedge has an upper side and a lower side that enclose an angle between approximately 4 and 12 degrees relative to one another.

10. A foot-support sole according to claim 1, wherein the outsole and the wedge are a single plastic component.

11. A foot-support sole according to claim 1, wherein the front edge of the wedge and the center line of the sole enclose an angle of 77°.

12. A foot-support sole according to claim 1, wherein the raised toe region of the outsole has an upwardly curving shape.

13. A foot-support sole according to claim 1, wherein the wedge has a transitional portion provided at the front edge so as to lead to the outsole.

14. A foot-support sole according to claim 5, wherein the front edge of the wedge and the start of the extremely raised portion of the outsole are separated by a distance.

15. A foot-support sole according to claim 1, wherein the wedge has a thickness in a heel region that is greater than a thickness in a region under the ball of the foot.

16. A foot-support sole according to claim 2, wherein the heel cushion is of a resilient material.

17. A foot-support sole according to claim 1, wherein the wedge extends from under the ball of the foot to an extreme end of a heel region of the sole.

* * * * *